US009236685B2

(12) United States Patent
He

(10) Patent No.: US 9,236,685 B2
(45) Date of Patent: Jan. 12, 2016

(54) QUICKLY CONNECTABLE PLUG AND SOCKET FOR POWER CONNECTION OF ELECTRICAL LIGHTING APPARATUS

(71) Applicant: Zhiliang He, Guangdong Province (CN)

(72) Inventor: Zhiliang He, Guangdong Province (CN)

( * ) Notice: Subject to any disclaimer, the term of this patent is extended or adjusted under 35 U.S.C. 154(b) by 41 days.

(21) Appl. No.: 14/333,491

(22) Filed: Jul. 16, 2014

(65) Prior Publication Data

US 2015/0118877 A1 Apr. 30, 2015

(30) Foreign Application Priority Data

Oct. 25, 2013 (CN) ..... 2013 2 0663693 U

(51) Int. Cl.

| | |
|---|---|
| ***H01R 13/62*** | (2006.01) |
| ***H01R 13/627*** | (2006.01) |
| ***H01R 13/625*** | (2006.01) |
| *H01R 103/00* | (2006.01) |
| *H01R 13/24* | (2006.01) |
| *H01R 13/64* | (2006.01) |
| *H01R 25/14* | (2006.01) |

(52) U.S. Cl.

CPC ..... *H01R 13/6277* (2013.01); *H01R 13/625* (2013.01); *H01R 13/2421* (2013.01); *H01R 13/64* (2013.01); *H01R 25/142* (2013.01); *H01R 2103/00* (2013.01)

(58) Field of Classification Search

CPC ..... H01R 13/629; H01R 13/6277; H01R 13/625; H01R 13/2421; H01R 13/64; H01R 2103/00; H01R 25/142

USPC ..... 439/180, 182, 241, 236, 226

See application file for complete search history.

(56) References Cited

U.S. PATENT DOCUMENTS 7,726,869 B2 * 6/2010 Chien ..... 362/648

* cited by examiner

*Primary Examiner* — Javaid Nasri

(57) ABSTRACT

A quickly connectable plug and socket for power connection of electrical lighting apparatus comprising a male plug which is capable to be inserted and connected with a female socket; conductive contact pieces are provided in the female socket; conductive pins are provided on the male plug; at least two resilient claws are arranged along a circumference of a cavity of an insertion portion of the female socket; each resilient claw is provided with first teeth axially arranged in a column with respect to the female socket; outer circumferential surface of an insertion portion of the male plug is provided with second teeth corresponding to the first teeth and arranged axially in columns with respect to the male plug; the insertion portion of the female socket is also provided with a position limiting groove; a position limiting button corresponding to the position limiting groove is provided on the male plug.

5 Claims, 2 Drawing Sheets

QUICKLY CONNECTABLE PLUG AND SOCKET FOR POWER CONNECTION OF ELECTRICAL LIGHTING APPARATUS

BACKGROUND OF THE INVENTION

The present invention relates to electrical parts for power connection of electrical appliances, and more specifically relates to a set of quickly connectable plug and socket for power connection of electrical lighting apparatus.

Nowadays, because of wiring inside an electrical lighting apparatus, light body of the electrical lighting apparatus cannot be removed separately. For example, a light body of an existing LED track light is mounted on a track via a gliding seat, and powering wires inside the light body for supplying power to the light are connected with power connection wires pre-installed in the track through the gliding seat; therefore, the gliding seat and the light body are usually formed as a one whole piece; when the light body has to be removed, the gliding seat has to be removed as well. As such, it is inconvenient to remove the light body for maintenance and replacement. A kind of power supply plug and socket which can be plugged and unplugged quickly is desired between the gliding seat and the light body or between any components alike so that the light body can be removed separately for maintenance or replacement.

BRIEF SUMMARY OF THE INVENTION

In view of the aforesaid disadvantages now present in the prior art, the present invention provides a set of quickly connectable plug and socket for power connection of electrical lighting apparatus enabling quick plugging and unplugging, convenient installation and removal, and reliable connection.

The present invention adopts the following technical proposal:

A quickly connectable plug and socket for power connection of electrical lighting apparatus comprises a male plug which can be inserted and connected with a female socket; conductive contact pieces are provided in the female socket; conductive pins contactable correspondingly with the conductive contact pieces are provided on the male plug; at least two resilient claws are symmetrically arranged along a circumference of a cavity of an insertion portion of the female socket; each resilient claw of the resilient claws is provided with first teeth axially arranged in a column with respect to the female socket; outer circumferential surface of an insertion portion of the male plug is provided with second teeth which is capable to be fitted correspondingly with the first teeth and which are arranged axially in columns with respect to the male plug; the insertion portion of the female socket is also provided with a position limiting groove; a position limiting button corresponding to the position limiting groove is provided on the male plug.

One end of each resilient claw is a free end and another end of each resilient claw is a fixed end; the free end is tilted inwardly with respect to the fixed end at a certain angle towards inner part of the cavity of the insertion portion.

The fixed end of each resilient claw is provided with a guiding inclined surface.

A sectional surface of each resilient claw has an arc shape.

The position limiting button is provided on the male plug and is laterally displaceable; a reset spring is provided in an interior part of the position limiting button; a fitting surface corresponding to the position limiting groove and a press portion exposed from the insertion portion of the female socket are provided on an exterior part of the position limiting button.

The present invention has the following advantages: The present invention allows quick connection and disconnection between the male plug and the female socket and is suitable to be used by various kinds of electrical appliances. When the present invention is applied to electrical lighting apparatus, for example LED track light, light body of the light can be removed separately, thereby facilitating maintenance and replacement of the light body. Furthermore, the present invention enables reliable connection; disconnection can only be achieved through manual operation.

DETAILED DESCRIPTION OF THE INVENTION

The present invention is further described in detail below with reference to the accompanying drawings.

Figure 1:
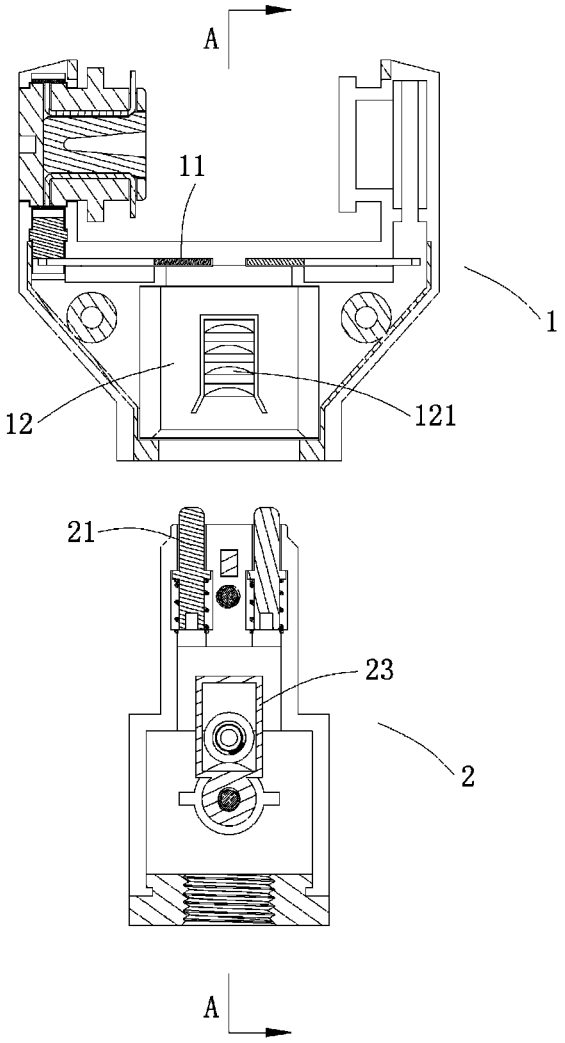
FIG. 1 shows a structure of the quickly connectable plug and socket for power connection of electrical lighting apparatus according to the present invention; in the figure, the male plug and the female socket are disconnected.
Figure 2:
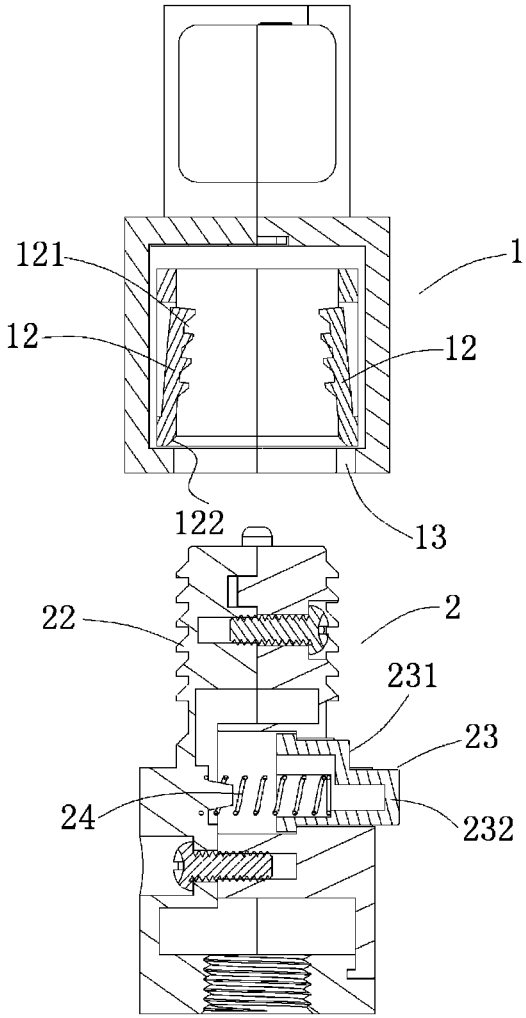
FIG. 2 is a sectional view along A-A of FIG. 1.

According to an embodiment as shown in FIG. 1 and FIG. 2, the quickly connectable plug and socket for power connection of electrical lighting apparatus comprises a male plug 2 which can be inserted and connected with a female socket 1; conductive contact pieces 11 are provided in the female socket 1; conductive pins 21 contactable correspondingly with the conductive contact pieces 11 are provided on the male plug 2; two (or three, or four) resilient claws 12 are symmetrically arranged along a circumference of a cavity of an insertion portion of the female socket 1; each resilient claw of the resilient claws 12 is provided with first teeth 121 axially arranged in a column with respect to the female socket 1; outer circumferential surface of an insertion portion of the male plug 2 is provided with second teeth 22 which can be fitted correspondingly with the first teeth 121 and which are arranged axially in columns with respect to the male plug 2; the first teeth 121 of each resilient claw and the second teeth 22 corresponding to the first teeth 121 of each resilient claw can both be arranged in one single column, or they can both be arranged in two or more columns according to practical needs; the insertion portion of the female socket 1 is also provided with a position limiting groove 13; a position limiting button 23 corresponding to the position limiting groove 13 is provided on the male plug 2.

An upper end of each resilient claw is a free end and a lower end of each resilient claw is a fixed end so that the upper end possesses resilience enough for deflection; the free end is tilted inwardly with respect to the fixed end at a certain angle towards inner part of the cavity of the insertion portion so that the first teeth 121 can securely engage with the second teeth 22 to prevent the male plug 2 from disengagement.

The fixed end of each resilient claw is provided with a guiding inclined surface 122 for guiding insertion of the insertion portion of the male plug 2; a sectional surface of each resilient claw has an arc shape adaptable to a cylindrical outer contour of the insertion portion of the male plug 2.

The position limiting button 23 is provided on the male plug 2 and is laterally displaceable; a reset spring 24 is provided in an interior part of the position limiting button 23; a fitting surface 231 corresponding to the position limiting groove 13 and a press portion 232 exposed from the insertion portion of the female socket 1 are provided on an exterior part of the position limiting button 23.

When the male plug 2 is inserted and connected with the female socket 1, the second teeth 22 on the male plug 2 is locked with the first teeth 121 on the resilient claws 12 to attain axial position limiting of the male plug 2 with respect to the female socket 1; also, the fitting surface 231 of the position limiting button 23 is locked in the position limiting groove 13 to attain radial position limiting of the male plug 2 with respect to the female socket 1. Accordingly, the male plug 2 and the female socket 1 are securely connected with each other. To disconnect the male plug 2 and the female socket 1, press the position limiting button 23 on the male plug 2 and then rotate the male plug 2 so that the second teeth 22 on the male plug 2 are unlocked from the first teeth 121 on the resilient claws 12, and the male plug 2 can then be unplugged from the female socket 1.

When this present invention is applied to an LED track light, the female socket can be mounted to a gliding seat, and the male plug can be mounted to a light body. Accordingly, the light body can be quickly connected and disconnected, thereby facilitating maintenance and replacement.

The above embodiment is only a more preferred embodiment of the present invention. The above embodiment is not described to limit the scope of the present invention. Equivalent changes and modification made in accordance with the teaching of the present invention should also fall within the scope of the present invention.

What is claimed is:

1. A quickly connectable plug and socket for power connection of electrical lighting apparatus comprising a male plug which is capable to be inserted and connected with a female socket; conductive contact pieces are provided in the female socket; conductive pins contactable correspondingly with the conductive contact pieces are provided on the male plug; at least two resilient claws are symmetrically arranged along a circumference of a cavity of an insertion portion of the female socket; each resilient claw of the resilient claws is provided with first teeth axially arranged in a column with respect to the female socket; outer circumferential surface of an insertion portion of the male plug is provided with second teeth which is capable to be fitted correspondingly with the first teeth and which are arranged axially in columns with respect to the male plug; the insertion portion of the female socket is also provided with a position limiting groove; a position limiting button corresponding to the position limiting groove is provided on the male plug.

2. The quickly connectable plug and socket for power connection of electrical lighting apparatus as in claim 1, wherein one end of each of the resilient claws is a free end and another end of each of the resilient claws is a fixed end; the free end is tilted inwardly with respect to the fixed end at a certain angle towards inner part of the cavity of the insertion portion.

3. The quickly connectable plug and socket for power connection of electrical lighting apparatus as in claim 2, wherein the fixed end of each of the resilient claws is provided with a guiding inclined surface.

4. The quickly connectable plug and socket for power connection of electrical lighting apparatus as in claim 3, wherein a sectional surface of each of the resilient claws has an arc shape.

5. The quickly connectable plug and socket for power connection of electrical lighting apparatus as in claim 1, wherein the position limiting button is provided on the male plug and is laterally displaceable; a reset spring is provided in an interior part of the position limiting button; a fitting surface corresponding to the position limiting groove and a press portion exposed from the insertion portion of the female socket are provided on an exterior part of the position limiting button.

* * * * *